US008220703B2

(12) United States Patent
Bolles

(10) Patent No.: US 8,220,703 B2
(45) Date of Patent: Jul. 17, 2012

(54) SECURE MAILBOX FOR PARCELS AND METHOD OF CONSTRUCTION THEREOF

(76) Inventor: David J. Bolles, Sammamish, WA (US)

( * ) Notice: Subject to any disclaimer, the term of this patent is extended or adjusted under 35 U.S.C. 154(b) by 0 days.

(21) Appl. No.: 13/113,861

(22) Filed: May 23, 2011

(65) Prior Publication Data

US 2011/0220708 A1 Sep. 15, 2011

Related U.S. Application Data

(63) Continuation of application No. 12/626,560, filed on Nov. 25, 2009, now Pat. No. 7,946,472.

(60) Provisional application No. 61/118,393, filed on Nov. 26, 2008.

(51) Int. Cl.
*B65G 11/04* (2006.01)

(52) U.S. Cl. ..... 232/45; 232/51; 109/68

(58) Field of Classification Search ..... 232/45, 232/47–52, 17, 44; 220/810, 826; 109/66–68
See application file for complete search history.

(56) References Cited

U.S. PATENT DOCUMENTS

| | | | | |
|---|---|---|---|---|
| 132,865 | A | 11/1872 | Sinclaire | |
| 446,257 | A | 2/1891 | Lane | |
| 462,093 | A | 10/1891 | Downing | |
| 1,111,031 | A | 9/1914 | Petri | |
| 5,207,377 | A | 5/1993 | Brecht | |
| 6,719,195 | B2 | 4/2004 | Farentinos | |
| 7,252,220 | B1 | 8/2007 | Shreve | |
| 7,320,427 | B2 | 1/2008 | Prestwich | |
| 2011/0084123 | A1 * | 4/2011 | Cox et al. | 232/28 |
| 2011/0259950 | A1 * | 10/2011 | Cox et al. | 232/27 |

* cited by examiner

*Primary Examiner* — William L. Miller

(74) *Attorney, Agent, or Firm* — Patrick J. S. Inouye; Krista A. Wittman

(57) ABSTRACT

A secure mailbox for parcels and method of construction thereof are presented. A mail shelf is affixed to an inner surface of a housing. An inner door is pivotably affixed to a bottom surface of the mail shelf and is rotatably movable on a top edge around a sphere of rotation defined by a bottom edge. A mail deposit having an outer door and inner door is constructed. The outer door is pivotably affixed to a front surface of the housing and is rotatably moveable on a bottom edge. The inner panel is affixed to the bottom edge of the outer door and includes a distal edge defining a sphere of rotation which is rotatably distinct from the sphere of rotation for the inner door. At least one connecting member is rotatably attached on one end to the inner door and on the other end to the mail deposit.

22 Claims, 2 Drawing Sheets

SECURE MAILBOX FOR PARCELS AND METHOD OF CONSTRUCTION THEREOF

CROSS-REFERENCE TO RELATED APPLICATION

This patent application is a continuation of application Ser. No. 12/626,560 filed Nov. 25, 2009, now U.S. Pat. No. 7,946,472, issued on May 24, 2011, which claims priority to U.S. Provisional Patent Application, Ser. No. 61/118,393, filed Nov. 26, 2008, the disclosure of which is incorporated by reference.

FIELD

The invention relates in general to mailboxes and, specifically, to a secure mailbox for parcels and method of construction thereof.

BACKGROUND

Identity theft is currently the fastest growing crime in the U.S. All too often, thieves steal mail as an easy and relatively low risk way of acquiring personal information that may be assembled into viable and marketable information for identity theft. Many consumers purchase "locking security" mailboxes in an attempt to thwart mail theft.

The locking parcel mailboxes are a popular product because they allow consumers to receive packages and parcels that would otherwise not fit into traditional locking mailboxes. The lock on a parcel mailbox attempts to prevent unauthorized users, such as would be thieves from obtaining a parcel once deposited into the mailbox. However, a locking mechanism only provides a partial solution since the parcel mailboxes generally include a non-lockable door through which the parcel is deposited. Once deposited, the parcel is located in a compartment protected by the locking mechanism. However, security is compromised by the non-lockable door, which, when open, allows the unauthorized user to simply insert their arm into the interior of the mailbox to retrieve the contents, thereby bypassing the locked door. Accordingly, there is a need for a mailbox that prevents possible theft by minimizing an opening formed when a mailbox door is opened.

SUMMARY

A theft-resistant mailbox for parcels includes a housing that is enclosed by a bottom plate, a rear wall, and one or more doors, which are affixed to a front surface of the housing. The doors can include a lockable parcel receipt door and a non-lockable parcel access door, which are each pivotably attached to the front of the housing. The parcel receipt door can be affixed at a bottom edge to an inner panel to form a rotatable mail deposit for receiving packages and parcels. An inner door can be pivotably affixed to a top panel, such as the inner top surface of the housing or a bottom surface of a mail shelf via a fulcrum or bearing. The inner door is further affixed to the rotatable mail deposit via an entrainment mechanism, such as connecting members, so that the inner door and parcel receipt door move together as the parcel receipt door is opened and closed. Upon opening, the parcel receipt door and the inner door move in concert until the inner door and the inner panel are aligned. When aligned, access to the interior of the mailbox is minimized by a combination of the inner door and the inner panel.

A further embodiment provides a secure mailbox for parcels and method of construction thereof. A mail shelf is affixed to an inner surface of a housing. An inner door is pivotably affixed to a bottom surface of the mail shelf and is rotatably movable on a top edge around a sphere of rotation defined by a bottom edge. A mail deposit having an outer door and inner door is constructed. The outer door is pivotably affixed to a front surface of the housing and is rotatably moveable on a bottom edge. The inner panel is affixed to the bottom edge of the outer door and includes a distal edge defining a sphere of rotation which is rotatably distinct from the sphere of rotation for the inner door. At least one connecting member rotatably attached on one end to the inner door and on the other end to the mail deposit.

Still other embodiments of the invention will become readily apparent to those skilled in the art from the following detailed description, wherein are described embodiments of the invention by way of illustrating the best mode contemplated for carrying out the invention. As will be realized, the invention is capable of other and different embodiments and its several details are capable of modifications in various obvious respects, all without departing from the spirit and the scope of the invention. Accordingly, the drawings and detailed description are to be regarded as illustrative in nature and not as restrictive.

DETAILED DESCRIPTION

Figure 1:
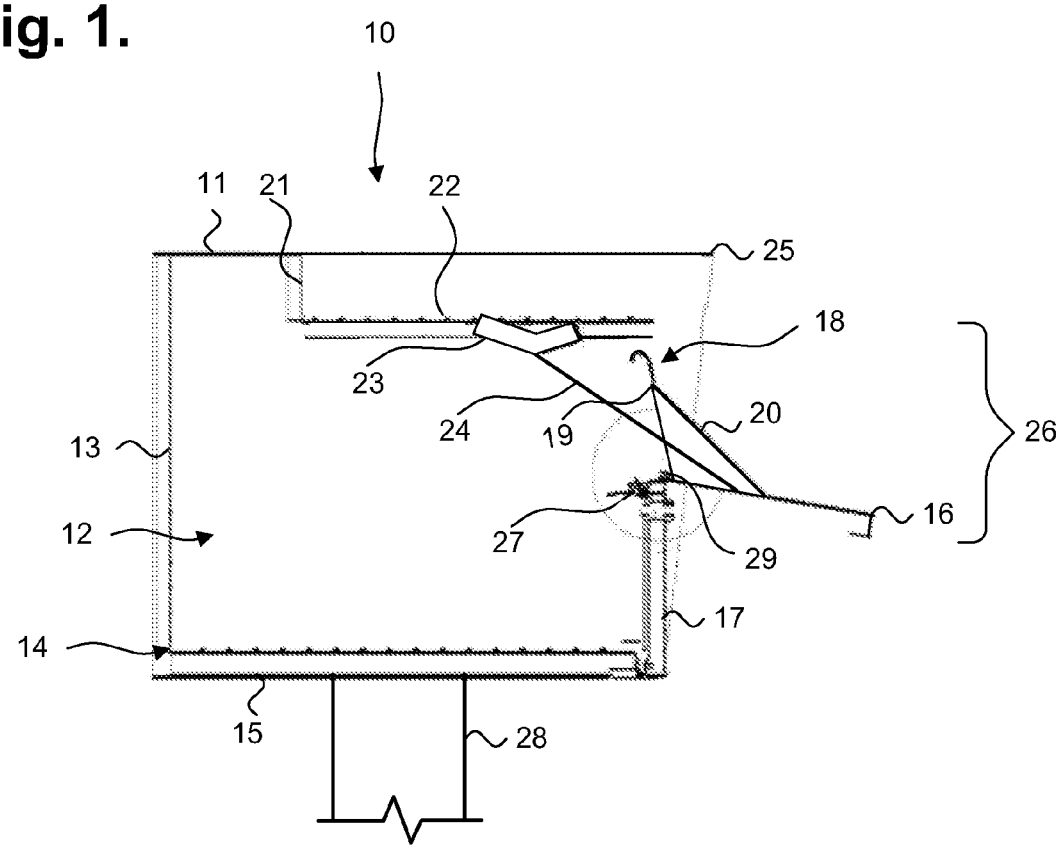
FIG. 1 is a side elevational view showing a theft-resistant mailbox for parcels, in accordance with one embodiment.

Conventionally, parcel mailboxes have an unlockable door that allows receipt of parcels, but provides access to an interior of the mailbox when opened. A theft-resistant mailbox for parcels minimizes access to the interior to prevent theft of the parcels. FIG. 1 is a side elevational view showing a theft-resistant mailbox 10 for parcels, in accordance with one embodiment. The theft-resistant mailbox 10 includes a housing 11, which forms an enclosure 12 for storing mail, parcels, and other articles. The housing 11 is formed in an inverted U-shape, to which a rear wall 13 is fixedly attached. A bottom plate 14 is fixedly attached to the housing 11 during assembly to provide a floor. One or more doors 16, 17 are attached to a front surface of the housing 11.

The mailbox 10 can be securely affixed to a mounting post 28 using a secure mounting bracket 15. The secure mounting bracket 15 enables the mailbox 10 to be robustly installed without exposing mounting hardware to breakage or compromise. The bracket 15 can be robustly secured to the mounting post, or other level or horizontal surface through internally accessible post and housing fasteners, such as described in commonly-owned U.S. Pat. No. 7,448,531, the disclosure of which is incorporated by reference. Finally, the mailbox 10 can include an outgoing mail pick-up flag (not shown) that can be operated through a pivotable mount (not shown).

On the front surface of the mailbox 10, a parcel receipt door 16 is positioned near a top surface of the housing 11 and a parcel access door 17 is positioned below the parcel receipt door 16. The front surface generally means the side of the mailbox 10 by which mail is received. The parcel receipt door 16 can include a substantially flat door with a handle, which is affixed at a bottom edge to the front surface of the housing via a fulcrum 29 and is rotatably moveable for opening and closing. The parcel receipt door 16 is affixed by the fulcrum 29 in such a way that the door can articulate through a range of motion about a horizontal axis, causing the parcel receipt door 16 to open away from the front surface of the housing 11 to receive parcels, all the way to a closed position, at which the parcel receipt door 16 is positioned along the front surface of the housing 11. Fulcrum fixation of the parcel receipt door 16 can include a hinge style attachment, a ball and joint device, rods, or a gear mechanism. Other methods and components for affixing the parcel receipt door to the fulcrum can be used.

When the parcel receipt door 16 is in an open position, access to a mail shelf 22 can be provided. The mail shelf 22 can include a substantially flat surface affixed to the inner top surface of the housing via a shelf support mechanism 21 to create a compartment large enough to accommodate substantially flat mail or appropriately sized packages for outbound mail pick-up by a postal worker. The shelf support mechanism 21 can include a hang bar or rod, as well as other mechanisms. In a further embodiment, the mail shelf 22 can be attached to the inner side surfaces of the housing 11. When the parcel receipt door 16 is closed, no access to the mail shelf 22 is provided.

The parcel receipt door 16 can include an inner panel 19, which is located within the interior 12 of the housing 11 and affixed at an angle to the parcel receipt door 16 to receive and guide incoming parcels into the mailbox 10. More specifically, a proximal edge of the inner panel 19 can be affixed to the bottom edge of the parcel receipt door 16. The angle between the inner panel 19 and parcel receipt door 16 can vary to accommodate different size packages. In one embodiment, the angle is at least as great as a right angle. Together, the parcel receipt door 16 and inner panel 19 rotate about a horizontal axis based on the opening and closing of the parcel receipt door 16. A sphere of rotation is defined by movement of a distal edge of the inner panel within the housing based on the horizontal axis.

Additionally, one or more side panels 20 can be interfixed between the parcel receipt door 16 and inner panel 19 to assist in guiding the parcel into the mailbox 10. The side panels can include a rod, bar, or flat surface. Other types of side panels are possible. Together, the parcel receipt door 16, inner panel 17, and side panels 19 form a rotatable mail deposit 26 that allows mail carriers and other individuals to deliver mail, envelopes, parcels, and other articles into the mailbox 10. The rotatable mail deposit 26 can be rotatably affixed to the front surface of the housing 11 via the parcel receipt door 16, as described above, inner panel 17, or side panels 19.

The mail deposit 26 can be rotated to open and closed positions in concert with an inner door 23, which is rotatably affixed to a bottom side of a top panel within the housing 11 via a fulcrum (not shown). The top panel inside the housing 11 can include a top surface of the housing itself or the mail shelf 22. The inner door 23 moves about a sphere of rotation, defined by a bottom edge, that is distinct from the sphere of rotation for the inner panel 19. At one or more positions of rotation, the inner door 19 and the inner panel 23 are substantially aligned to prevent access to the enclosure 12 of the mailbox 10 caused by the opening and closing of the parcel receipt door 16. Alignment of the inner door and inner panel are further discussed below with reference to FIG. 3.

The inner door 23 can include a plate that is substantially straight or that has a bend at a particular angle. The particular angle and length of the inner door 23 can vary as long as the inner door 23 and inner panel 19 can be aligned at one or more points within the distinct spheres of rotation, such that no overlap exists between the inner door 23 and inner panel 19. The inner door 23 can be any type of material, such as metal or plastic, which effectively blocks access to the interior enclosure 12 of the mailbox 10 when the parcel receipt door 16 is in the open or semi-open position. Other materials for and shapes of the inner door are possible. The fulcrum allows the inner door to rotate freely through a range of motion. Fulcrum fixation of the inner door 23 can include a hinge style attachment, or a ball and joint device. Other methods and components for affixing the fulcrum are possible. The inner door 23 can pivotally rotate in concert with the parcel receipt door 16 via an entrainment mechanism, such as one or more connecting members 24.

The connecting members 24 are each rotatably attached on one end to a side edge of the inner door 23 and on the other end to a side edge of the mail receipt door 16. Each connecting member 24 should be attached to the same side edges of the inner door and mail receipt door. In a further embodiment, one end of the connecting members 24 can be attached to the inner panel or side panels of the rotatable mail deposit. The connecting members 24 can include rods, wires, or gears. For example, rods can be attached to both the inner door 23 and parcel receipt door 16 by way of a simple hole and socket attachment or a bushing style fixture. A gear mechanism could utilize either a wheeled tooth drive on both the inner door 23 and the parcel receipt door 16, or a pulley and cable style system, to achieve entrainment of the inner door 23 and the parcel receipt door 16. Other types of connecting members are possible.

Accordingly, opening the parcel receipt door 16 causes the inner door 23 to pull forward towards the front surface of the housing 11, limiting the effective access to the contents of the mailbox 10. Meanwhile, closing of the parcel receipt door 16 causes the inner door 23 to move towards the rear wall 13 of the housing 11 creating a passage between the inner door 23 and inner panel 19 to allow the parcel to pass to the interior 12 of the mailbox 10. Access to the parcel through the passage is protected by the closing or closed parcel receipt door 16, which is further discussed below with reference to FIG. 4.

During opening and closing of the parcel receipt door 16, access to the interior 12 of the housing 11 can be partially obstructed by an overhang 25 of a top surface of the housing 11. The overhang 25 minimizes access to the interior 12 by narrowing an opening caused by the open parcel receipt door 16. The overhang 25 is formed by extending a top surface of the housing 11 over and beyond the bottom wall 14 and front surface of the housing 11.

The parcel access door 17 is located below the parcel receipt door 16 to provide access to the enclosed space 12 within the housing 11. The parcel access door 17 is pivotably affixed to the front surface of the housing 11 on a bottom edge via a hinge assembly or other rotatable assembly. A lock mechanism 27 can be provided on the parcel access door 17 to prevent access to mail, parcels or articles located within the interior 12 of the mailbox 10, except by those individuals having a key to operate the lock mechanism 27. Unauthorized access to mail or articles that have been delivered is prevented by the locking mail access door, as well as by a combination of the inner door and rotatable mail deposit. In one embodiment, the lock mechanism includes a lock and a latch. A further locking mechanism suitable for use with the mailbox is described in commonly-owned U.S. Pat. No. 7,441,696, the disclosure of which is incorporated by reference. Other components and mechanisms for securing the parcel access door 17 are possible. The shape and size of the mailbox housing 11 and parcel receipt door 16 can be varied to allow parcels of different sizes.

Figure 2:
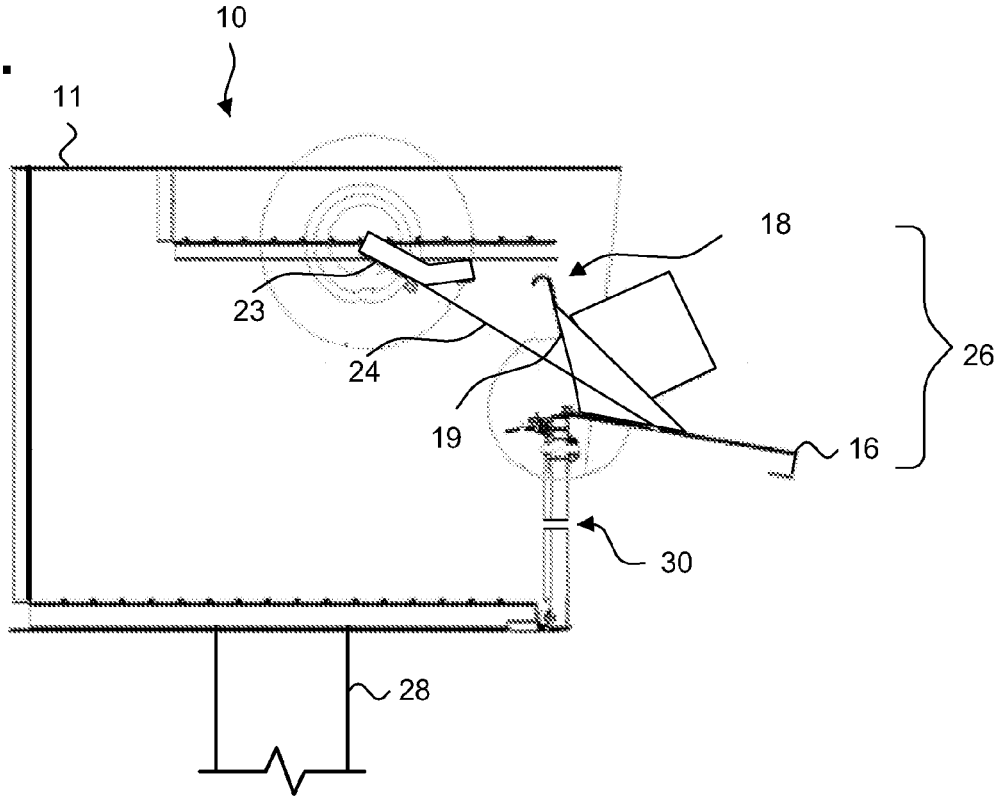
FIG. 2 is a side elevational view showing the theft-resistant mailbox of FIG. 1 with a parcel receipt door in an open position.

FIG. 2 is a side elevational view showing the theft-resistant mailbox 10 of FIG. 1 with a parcel receipt door 16 in an open position. When open, a user can place a parcel into the rotatable mail deposit 26 formed by at least the parcel receipt door 16 and inner panel 19. The inner panel 19 can be positioned to obstruct access to the interior 12 of the housing 11 when the parcel receipt door 16 is opened. However, a slot 18 can be formed between a top panel of the housing 11 and the inner panel 19 of the rotatable mail deposit 26 to insert inbound mail without allowing an unauthorized user to reach a hand or other object into the mailbox. Once deposited, the inbound mail falls to the inner floor of the mailbox 10 for retrieval through the locked parcel access door 17 by individuals with a key. In a further embodiment, various slots or spaces can be formed within the housing 11 of the mailbox 10 to insert standard thin envelope mailers and envelope style mail without having to open or close the parcel receipt door 16. The slots and spaces should be small enough to prevent unauthorized access. In yet a further embodiment, the slots and spaces can be formed within the parcel receipt door 16 or parcel access door 17 for receiving mail into the housing.

Figure 3:
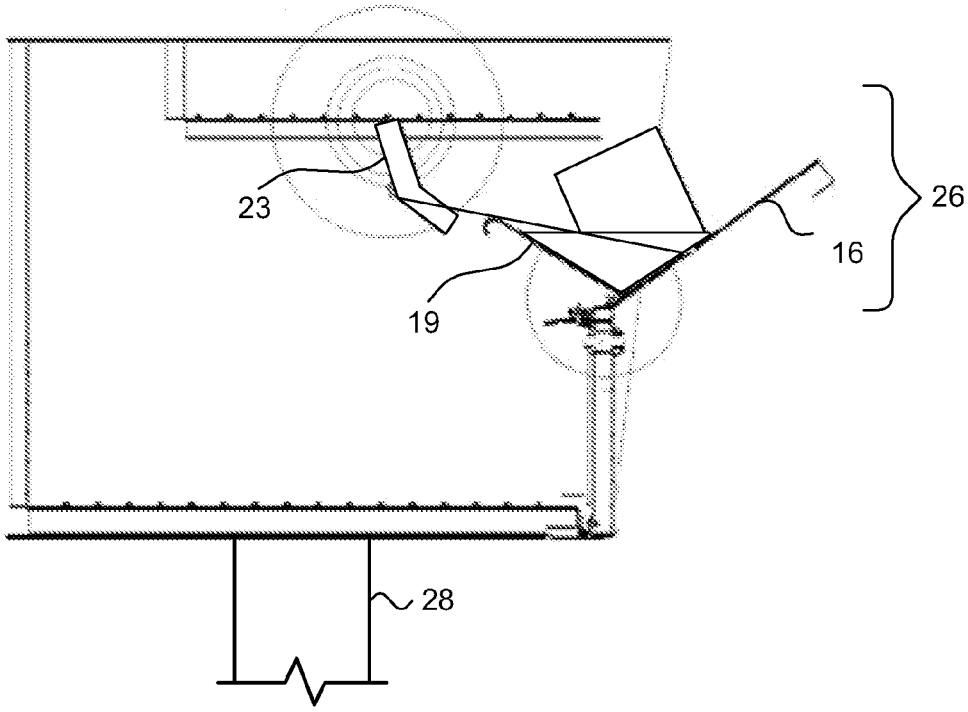
FIG. 3 is side elevational view showing the theft-resistant mailbox of FIG. 1 with a parcel receipt door in a semi-open position.

FIG. 3 is side elevational view showing the theft-resistant mailbox 10 of FIG. 1 with a parcel receipt door 16 in a semi-open position. Once, the parcel is placed into the rotatable parcel deposit 26, the parcel receipt door 17 can be moved into a closed position for depositing the parcel in the interior 12 of the mailbox 10. During closing of the parcel receipt door 16, the inner door 19 and the parcel receipt door 16 move in concert toward the rear wall of the housing. Upon reaching one or more particular points of rotation when the parcel receipt door 16 is in a semi-open position, the distal edge of the inner panel 19 and the bottom edge of the inner door 23 can be substantially aligned to minimize access to the enclosure 12 of the housing 11 by obstructing an opening otherwise formed when the parcel receipt door 16 is opened. Closing the parcel receipt door 16 causes the inner door 23 to move out toward the rear wall of the housing 11 to allow the parcel or mail to freely slide into the secure area 12 of the mailbox 10.

Additionally, when the parcel receipt door is moved in an opposite direction into an open position, the inner panel 19 and the inner door 23 move in concert toward the front surface of the housing 11 and can be substantially aligned at the same points of rotation to prevent an authorized user, such as a mail thief from inserting a hand or other object into the mailbox 10 when the parcel receipt door 16 is open or semi-open. Upon further opening, the inner door continues to move toward the front surface of the mailbox to prevent access to the interior housing.

Figure 4:
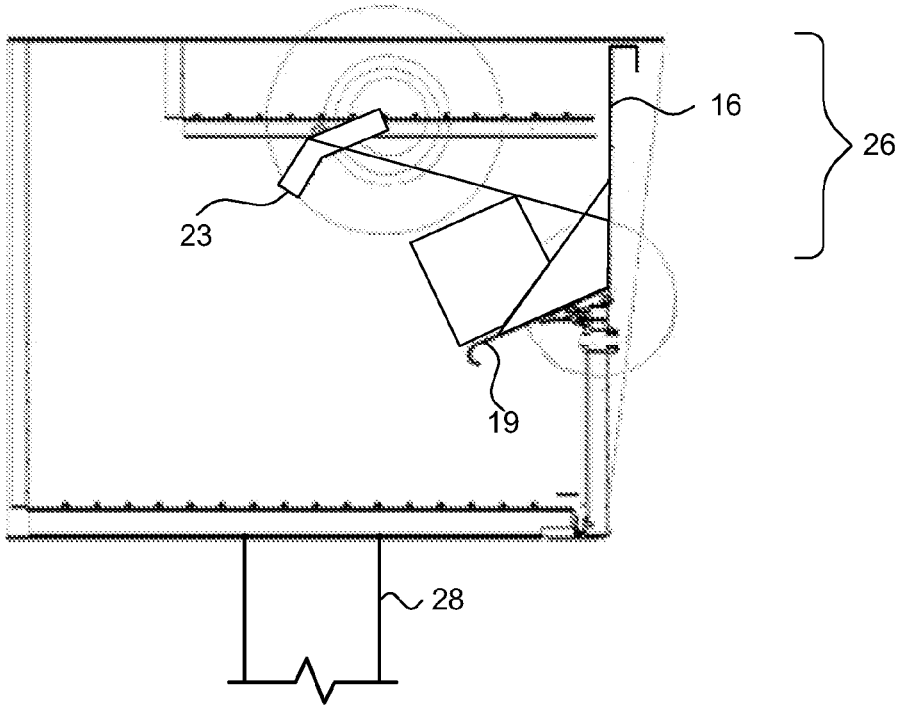
FIG. 4 is a side elevational view showing the theft-resistant mailbox of FIG. 1 with a parcel receipt door in a closed position.

FIG. 4 is a side elevational view showing the theft-resistant mailbox 10 of FIG. 1 with a parcel receipt door 16 in a closed position. In the closed position, the parcel receipt door 16 is positioned along the front surface of the housing 11 to obstruct access to the interior 12 of the mailbox 10. The inner panel 19 is positioned down toward the bottom surface of the mailbox 10 to guide the loaded parcel into the enclosure 12. The inner door 23 is positioned toward the rear wall 13 of the mailbox 10 to provide access for the parcel to move into the enclosure 12.

Once the parcel is located within the enclosure 12 of the housing 11, an authorized user can obtain the parcel through the locked parcel access door 17 with a key. Additionally, unauthorized users are prevented from obtaining the package if they do not have a key to the lock. More particularly, access to the interior 12 of the housing 11 is prevented at all times during opening and closing of the parcel receipt door by the combination of the inner door and mail deposit 26.

Although the above has been described with respect to parcels, other types of mailable items are possible including packages, boxes, containers, or other two- and three-dimensional objects.

While the invention has been particularly shown and described as referenced to the embodiments thereof, those skilled in the art will understand that the foregoing and other changes in form and detail may be made therein without departing from the spirit and scope of the invention.

What is claimed is:

1. A secure mailbox for parcels, comprising:

a mail shelf comprising a flat surface affixed to an inner surface of a housing defining an enclosed space;

an inner door pivotably affixed to a bottom surface of the mail shelf and rotatably moveable on a top edge around a sphere of rotation defined by a bottom edge;

a mail deposit, comprising:

an outer door pivotably affixed to a front surface of the housing and rotatably moveable on a bottom edge; and an inner panel fixedly attached to the bottom edge of the outer door and comprised of a distal edge defining a sphere of rotation which is rotatably distinct from the sphere of rotation for the inner door; and at least one connecting member rotatably attached on one end to the inner door and on the other end to the mail deposit.

2. A theft-resistant mailbox according to claim 1, wherein the mail deposit further comprises:

one or more side panels interfixed between the outer door and the inner panel.

3. A theft-resistant mailbox according to claim 1, further comprising:

a lockable mail door pivotably affixed to the front surface of the housing below the outer door and through which access is provided to the enclosed space of the housing.

4. A theft-resistant mailbox according to claim 1, wherein the mail shelf is affixed to the housing via a support mechanism comprising one or more of a hang bar and rod.

5. A theft-resistant mailbox according to claim 1, further comprising:

an overhang located at a top front surface of the housing and extending over the outer door.

6. A theft-resistant mailbox according to claim 1, further comprising at least one of:

a slot formed on the front surface of the housing; and a handle affixed to a top edge of the outer door.

7. A theft-resistant mailbox according to claim 1, wherein the inner panel is located within the housing when the outer door is in a closed position and pivots toward the front side of the housing when the outer door is opened, such that access to the enclosed space is blocked by the inner panel when the outer door is substantially fully opened.

8. A theft-resistant mailbox according to claim 1, wherein the connecting member comprises at least one of a rod, wire, and gear.

9. A theft-resistant mailbox according to claim 1, wherein the inner panel is affixed to the bottom edge of the outer door such that the sphere of rotation of the inner panel is defined within the enclosed space of the housing.

10. A theft-resistant mailbox according to claim 1, wherein the outer door and inner panel are affixed at an angle comprising at least one of a right angle and an obtuse angle.

11. A theft-resistant mailbox according to claim 1, wherein the inner door comprises one of a substantially straight plate or a plate with a bend having a particular angle.

12. A method for constructing a secure mailbox for parcels, comprising:

affixing a mail shelf comprising a flat surface to an inner surface of a housing defining an enclosed space;

pivotably affixing an inner door to a bottom surface of the mail shelf that is rotatably moveable on a top edge around a sphere of rotation defined by a bottom edge;

constructing a mail deposit, comprising:

pivotably affixing an outer door to a front surface of the housing that is rotatably moveable on a bottom edge; and fixedly attaching an inner panel to the bottom edge of the outer door that is comprised of a distal edge defining a sphere of rotation which is rotatably distinct from the sphere of rotation for the inner door; and rotatably attaching at least one connecting member on one end to the inner door and on the other end to the mail deposit.

13. A method for constructing a secure mailbox according to claim 12, further comprising:

interfixing one or more side panels between the outer door and the inner panel.

14. A method for constructing a secure mailbox according to claim 12, further comprising:

pivotably affixing a lockable mail door on the front surface of the housing below the outer door through which access is provided to the enclosed space of the housing.

15. A method for constructing a secure mailbox according to claim 12, wherein the mail shelf is affixed to the housing via a support mechanism comprising one or more of a hang bar and rod.

16. A method for constructing a secure mailbox according to claim 12, further comprising:

providing an overhang at a top front surface of the housing that extends over the outer door.

17. A method for constructing a secure mailbox according to claim 12, further comprising:

forming a slot on the front surface of the housing; and affixing a handle to a top edge of the outer door.

18. A method for constructing a secure mailbox according to claim 12, wherein the inner panel is located within the housing when the outer door is in a closed position and pivots toward the front side of the housing when the outer door is opened, such that access to the enclosed space is blocked by the inner panel when the outer door is substantially fully opened.

19. A method for constructing a secure mailbox according to claim 12, wherein the connecting member comprises at least one of a rod, wire, and gear.

20. A method for constructing a secure mailbox according to claim 12, wherein the inner panel is affixed to the bottom edge of the outer door such that the sphere of rotation of the inner panel is defined within the enclosed space of the housing.

21. A method for constructing a secure mailbox according to claim 12, wherein the outer door and inner panel are affixed at an angle comprising at least one of a right angle and an obtuse angle.

22. A method for constructing a secure mailbox according to claim 12, wherein the inner door comprises a plate comprising one of a substantially straight plate or a plate with a bend having a particular angle.

* * * * *